US006554266B2

(12) United States Patent
Nanba et al.

(10) Patent No.: US 6,554,266 B2
(45) Date of Patent: Apr. 29, 2003

(54) GUIDE APPARATUS FOR USE IN FOLDER

(75) Inventors: Takeo Nanba, Yokohama (JP); Takao Narui, Inagi (JP)

(73) Assignee: Tokyo Kikai Seisakusho Ltd, Tokyo (JP)

( * ) Notice: Subject to any disclaimer, the term of this patent is extended or adjusted under 35 U.S.C. 154(b) by 55 days.

(21) Appl. No.: 09/915,364

(22) Filed: Jul. 27, 2001

(65) Prior Publication Data

US 2002/0063372 A1 May 30, 2002

(30) Foreign Application Priority Data

Nov. 24, 2000 (JP) ..... 2000-357247

(51) Int. Cl.[7] ..... B65H 45/28

(52) U.S. Cl. ..... 270/47; 270/32; 493/425; 271/69

(58) Field of Search ..... 493/416, 417, 493/428, 425, 426; 270/32, 38, 47, 48, 49, 50; 271/69

(56) References Cited

U.S. PATENT DOCUMENTS 3,758,102 A * 9/1973 Munn et al. ..... 493/342
4,494,949 A * 1/1985 Baley ..... 493/432
4,521,007 A * 6/1985 Darda ..... 226/195
4,697,805 A * 10/1987 Herb ..... 270/47
4,807,865 A * 2/1989 Kobler et al. ..... 270/52.22
4,817,932 A * 4/1989 Stab et al. ..... 270/47
5,013,020 A * 5/1991 Stoll ..... 270/13
5,226,871 A * 7/1993 Skipor ..... 493/425
5,466,212 A * 11/1995 Springer ..... 492/48
5,702,341 A * 12/1997 Keilhau ..... 271/303
5,807,227 A * 9/1998 Field ..... 493/357
6,092,804 A * 7/2000 Wingate ..... 270/21.1

FOREIGN PATENT DOCUMENTS

JP 2-119463 9/1990

* cited by examiner

*Primary Examiner*—Patrick H. Mackey
(74) *Attorney, Agent, or Firm*—Armstrong, Westerman & Hattori, LLP

(57) ABSTRACT

A guide apparatus is composed of a guide plate which is disposed in such a manner as to be able to move between an active position located within the sheet transfer space and a retreat position where the guide plate does not interfere with the sheet transferring from the collect cylinder to the jaw cylinder; a position-changeover drive unit for moving the guide plate between the active position and the retreat position; a printing-speed detection unit for detecting the driving speed of a rotary press and outputting a driving speed signal during printing; and a control unit for outputting, upon reception of the driving speed signal from the printing-speed detection unit, a position changeover signal to the position-changeover drive unit in order to move the guide plate accordingly.

3 Claims, 5 Drawing Sheets

GUIDE APPARATUS FOR USE IN FOLDER

BACKGROUND OF THE INVENTION

1. Field of the Invention

The present invention relates to a guide apparatus for use in a folder equipped with a cutting cylinder, a collect cylinder, a jaw cylinder, and a paper guide in a rotary press.

2. Description of the Related Art

A conventional folder of a rotary press, particularly a folder equipped with a cutting cylinder, a collect cylinder, a jaw cylinder, and a paper guide, is disclosed in, for example, Japanese Utility Model Application Laid-Open (kokai) No. 2-119463.

In the folder disclosed in Japanese Utility Model Application Laid-Open (kokai) No. 2-119463, a web which is fed to a gap between the collect cylinder and the cutting cylinder is cut by the cutting cylinder into sheets. A lead portion of each sheet is held on the collect cylinder by a pin which is provided on the collect cylinder and is stuck into the lead portion. After the lead portion of the sheet passes the position of the minimum gap between the neighboring collect cylinder and jaw cylinder as a result of rotation of the collect cylinder, a central portion of the sheet is pressed by a tucking blade provided on the collect cylinder toward a jaw mechanism composed of a movable jaw and a stationary jaw and provided on the jaw cylinder. As a result, the central portion of the sheet is held by the jaw mechanism. After the pin which has been holding the lead portion of the sheet is withdrawn from the lead portion, the lead portion is separated from the outer circumferential surface of the collect cylinder and begins to move toward the jaw cylinder.

A paper guide formed of a brush is disposed above the collect cylinder and the jaw cylinder in such a manner that the paper guide extends continuously from the vicinity of the outer circumferential surface of the collect cylinder to the vicinity of the outer circumferential surface of the jaw cylinder. The lead portion of the sheet which has left the collect cylinder moves toward the jaw cylinder while being guided along the side of the paper guide which faces the outer circumferential surfaces of the folding and jaw cylinders.

However, the guide apparatus for use in a folder disclosed in Japanese Utility Model Application Laid-Open (kokai) No. 2-119463 involves the following problems.

In the guide apparatus, when the pin which has been holding the lead portion of a sheet is withdrawn from the lead portion, the lead portion of the sheet becomes free. Therefore, when the printing speed of the rotary press is very low, as shown in FIGS. 7 and 8, slack 30 or a curl 31 arises at a lead portion Q1' of the sheet. When the lead portion Q1' of the sheet moves toward a jaw cylinder G while having the slack 30 or the curl 31, the sheet is folded in a defective manner to thereby become a defectively folded sheet R' as shown in FIG. 9.

Particularly, when the rotary press is halted, the slack 30 or the curl 31, which arises at the lead portion Q1' of the sheet at low printing speed as shown in FIGS. 7, 8, and 9, occurs more significantly. Subsequently, when the jaw cylinder G and the collect cylinder F resume rotating upon restart of the rotary press, the lead portion Q1' of the sheet having the slack 30 or the curl 31 moves toward the jaw cylinder G. The slack 30 or the curl 31 is caught in the gap between a paper guide 10 and the outer circumferential surface of the jaw cylinder G, resulting in formation of the defectively folded sheet R'. The defectively folded sheet R' is jammed in the gap, causing mechanical breakage.

Thus, in printing preparation work (such as paper-threading work or printing adjustment work), which involves frequent start and stop of low-printing-speed operation, a worker must always observe the folder in preparation in order to remove defectively folded sheets discharged to the outside of the machine and to deal with jamming of defectively folded sheets. As a result, the burden imposed on the worker increases, and work efficiency is impaired.

SUMMARY OF THE INVENTION

In view of the foregoing, an object of the present invention is to provide a guide apparatus for use in a folder for preventing occurrence of a defectively folded sheet to thereby prevent occurrence of paper jam on a jay cylinder.

Another object of the present invention is to provide a guide apparatus for use in a folder which does not require a worker to observe a folder during printing preparation work, to thereby achieve laborsaving and enhancement of work efficiency.

To achieve the above objects, the present invention provides a guide apparatus for use in a folder in which a cutting cylinder and a jaw cylinder are disposed around a collect cylinder such that a gap is formed between the cutting cylinder and the collect cylinder and between the jaw cylinder face and the collect cylinder; pairs each consisting of a cutting bar extending axially and a pin are circumferentially arranged on an outer circumferential surface of the collect cylinder at circumferential intervals each corresponding to a length of a sheet such that the pins are projectable from an outer circumferential surface of the collect cylinder at locations adjacent to and behind the corresponding cutting bars in the rotational direction of the collect cylinder; tucking blades extending axially are each disposed at a substantially circumferentially central position between adjacent two of the cutting bars to be projectable from the outer circumferential surface of the collect cylinder; a knife extending axially projects from the outer circumferential surface of the cutting cylinder; jaw mechanisms are circumferentially arranged on the outer circumferential surface of the jaw cylinder at circumferential intervals each corresponding to the length of a sheet; a paper guide is disposed over an appropriate range covering a portion of the outer circumferential surface of the collect cylinder and a portion of the outer circumferential surface of the jaw cylinder, which portions are located downstream of a narrowest gap between the collect cylinder and the jaw cylinder with respect to rotational directions of the collect cylinder and the jaw cylinder, such that an inner surface of the paper guide faces the outer circumferential surfaces of the collect cylinder and the jaw cylinder while an appropriate gap is maintained therebetween and such that the inner surface of the paper guide, together with the outer circumferential surfaces of the collect cylinder and the jaw cylinder, defines a sheet transfer space having a substantially triangular cross section; and the knife and the cutting bar cooperatively cut off a sheet of predetermined length from a web, while the jaw mechanism and the tucking blade cooperatively fold the sheet.

The guide apparatus comprises a guide unit disposed in such a manner as to be able to move between an active position located within the sheet transfer space and apart from the outer circumferential surface of the collect cylinder to such an extent as not to allow the sheet to slack, and a retreat position where the guide unit does not interfere with the sheet transferring from the collect cylinder to the jaw cylinder; a position-changeover drive unit for moving the guide unit between the active position and the retreat position; a printing-speed detection unit for detecting the driving speed of a rotary press and outputting a driving speed signal during printing; and a control unit for outputting, upon reception of the driving speed signal from the printing-speed detection unit, a position changeover signal to the position-changeover drive unit in order to move the guide unit accordingly.

The thus-configured guide apparatus yields the following effects. Even in printing preparation work, which involves frequent start and stop of low-printing-speed operation, a defectively folded sheet does not occur, and thus paper jam, which is potentially caused by a defectively folded sheet, does not occur on the jaw cylinder.

Also, a worker does not need to observe the folder during printing preparation work, and thus laborsaving and enhancement of work efficiency are achieved.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENT

An embodiment of the present invention will next be described in detail with reference to the drawings.

Figure 1:
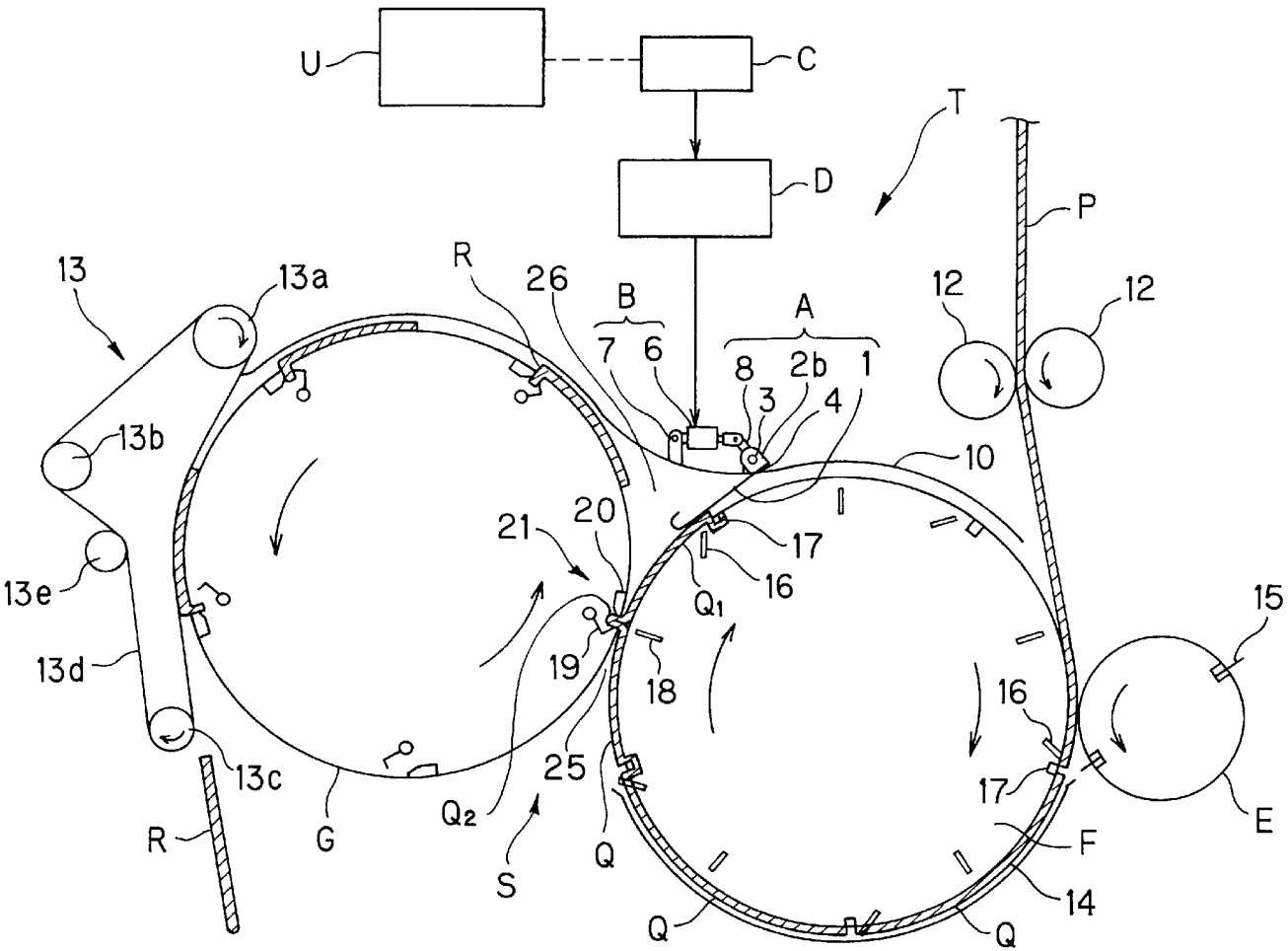
FIG. 1 is a schematic side view of a folder equipped with a guide apparatus according to an embodiment of the present invention.

As shown in FIG. 1, a folder S of a rotary press includes a cutting cylinder E, a collect cylinder F, and a jaw cylinder G, which are arranged in parallel with one another and such that the cutting cylinder E and the jaw cylinder G are disposed at diametrally opposite sides of the collect cylinder F. A gap for allowing paper to pass through is formed between the cutting cylinder E and the collect cylinder F and between the jaw cylinder G and the collect cylinder F.

Two knives 15 project from the outer circumferential surface of the cutting cylinder E at diametrally opposite positions. Pairs each consisting of a cutting bar 17 and a pin 16 are circumferentially arranged on the outer circumferential surface of the collect cylinder F at circumferential intervals each corresponding to half the circumferential length of the cutting cylinder E. The pins 16 are located adjacent to and behind the corresponding cutting bars 17 with respect to the rotational direction of the collect cylinder F. The pins 16 can project from and retract behind the outer circumferential surface of the collect cylinder F. Tucking blades 18 are each circumferentially disposed at a substantially circumferentially central position between adjacent pairs of the cutting bar 17 and the pin 16 in such a manner as to be able to project from and retract behind the outer circumferential surface of the collect cylinder F.

In the present embodiment, five pairs of the cutting bar 17 and the pin 16 are provided; five tucking blades 18 are provided; and the diameter of the collect cylinder F is 2.5 times that of the cutting cylinder E.

The diameter of the jaw cylinder G is substantially equal to that of the collect cylinder F. Five jaw mechanisms 21 each consisting of a movable jaw 19 and a stationary jaw 20 are disposed on the outer circumferential surface of the jaw cylinder G at circumferentially equal intervals.

Two facing nipping rollers 12 are disposed in the upstream vicinity of the paired cutting cylinder E and collect cylinder F with respect to the running direction of a web P in such a manner as to nip the fed web P therebetween. The nipping rollers 2 rotate at the same speed in opposite directions so as to feed the web P toward the gap between the cutting cylinder E and the collect cylinder F.

The cutting cylinder E and the collect cylinder F are rotated in opposite directions, as are the paired nipping rollers 12; and the jaw cylinder G is rotated in a direction opposite to the rotational direction of the collect cylinder F.

A signature guide belt 13 is disposed diametrally opposite the collect cylinder F with respect to the jaw cylinder G in such a manner as to face the outer circumferential surface of the jaw cylinder G.

The signature guide belt 13 includes an appropriate number of rollers (3 rollers in the present embodiment; i.e., 13*a*, 13*b*, and 13*c*), an endless belt 13*d* looped around the rollers 13*a*, 13*b*, and 13*c*, and a tension roller 13*e*. A portion of the endless belt 13*d* is in contact with the outer circumferential surface of the jaw cylinder G. The endless belt 13*d* travels in the direction opposite the rotational direction of the jaw cylinder G; i.e., clockwise, at a speed equal to the circumferential speed of the jaw cylinder G.

A paper guide 10 is disposed over an appropriate range covering a portion of the outer circumferential surface of the collect cylinder F and a portion of the outer circumferential surface of the jaw cylinder G, which portions are located downstream of the narrowest gap between the collect cylinder F and the jaw cylinder G with respect to the rotational directions of the collect cylinder F and the jaw cylinder G (in the present embodiment, as shown in FIG. 1, a range extending between a position in the vicinity of the signature guide belt 13 and a position in the vicinity of the web P fed from the nipping rollers 12). The inner surface of the paper guide 10 faces the outer circumferential surfaces of the collect cylinder F and the jaw cylinder G while an appropriate gap is maintained therebetween. The gap between the paper guide 10 and the jaw cylinder G is determined so as to allow passage of a folded sheet R.

A paper guide 14 is disposed along the outer circumferential surface of the collect cylinder F over a range extending, in the rotational direction of the collect cylinder F, from a position in the vicinity of the narrowest gap between the cutting cylinder E and the collect cylinder F to a position in the vicinity of the narrowest gap between the jaw cylinder G and the collect cylinder F. The gap between the inner surface of the paper guide 14 and the outer circumferential surface of the collect cylinder F is determined so as to allow passage of a sheet Q into which the pin 16 is stuck.

Figure 2:
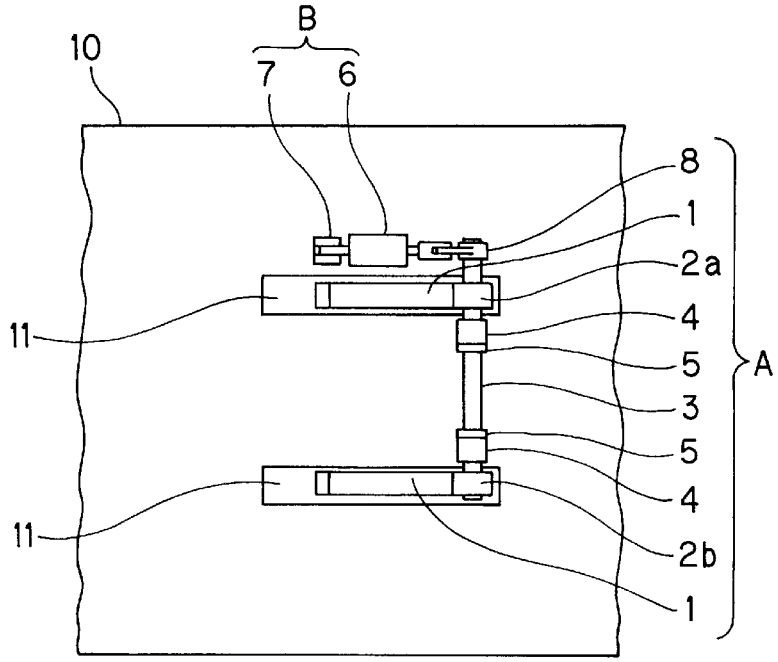
FIG. 2 is a plan view of the guide apparatus according to the embodiment.

A guide apparatus T is disposed on an intermediate portion of the paper guide 10 which extends between the collect cylinder F and the jaw cylinder G (in FIG. 1, a portion of the paper guide 10 which, together with the outer circumferential surfaces of the collect cylinder F and the jaw cylinder G, defines a space having a substantially triangular cross section; i.e., a sheet transfer space 26). Two elongated holes 11 are formed in the intermediate portion of the paper guide 10 in such a manner as to extend in a direction perpendicular to the axial direction of the jaw cylinder G and the collect cylinder F and are spaced appropriately in the axial direction of the jaw cylinder G and the collect cylinder F (see FIG. 2). The elongated holes 11 allow two guide plates 1 (which will be described later) of the guide apparatus T to pass therethrough during their swinging movement.

The guide apparatus T is composed of a guide unit A, a position-changeover drive unit B, a printing-speed detection unit C, and a control unit D.

1. Guide Unit A

As shown in FIGS. 2 to 5, two brackets 4 are mounted in a standing condition on the paper guide 10, which partially constitutes the folder S, on the side in opposition to the collect cylinder F and the jaw cylinder G such that they are axially arranged between end portions of the holes 11 located on the collect cylinder F side while an appropriate interval is established therebetween. A shaft 3 in parallel with the cylinder axis is rotatably supported by the brackets 4 such that end portions thereof project from the brackets 4. Two stopper rings 5 are fixedly attached to a portion of the shaft 3 which extends between the brackets 4, in such a manner as to be in contact with the corresponding mutually-facing surfaces of the brackets 4. The stopper rings 5 restrain axial movement of the shaft 3.

Opposite end portions of the shaft 3 which project from the brackets 4 differ in length. A block 2*a* and an arm 8, which is located axially inside the block 2*a,* are fixedly attached to the long projecting end portion of the shaft 3 so as to be rotatable together with the shaft 3. A block 2*b* is fixedly attached to the short projecting end portion of the shaft 3 so as to be rotatable together with the shaft 3. Base end portions of two elongated narrow, thin guide plates 1, which extend while being superimposed on the corresponding holes 11 as viewed from above, are fixedly attached to the corresponding surfaces of the blocks 2*a* and 2*b* which face the collect cylinder F. Free end portions of the guide plates 1 are curled away from the outer circumferential surface of the collect cylinder F.

2. Position-Changeover Drive Unit B

As shown in FIGS. 2 to 5, a bracket 7 is mounted on the paper guide 10 on the same side where the brackets 4 of the guide unit A are mounted. The bracket 7 is located such that the bracket 7 and the arm 8 are arranged in parallel with the longitudinal direction of the hole 11 while a certain distance is established therebetween.

A base portion of a fluid pressure cylinder 6 extending toward the arm 8 is rotatably coupled to the bracket 7 by use of a pin. An end of a rod of the fluid pressure cylinder 6 is rotatably coupled to an end of the arm 8 of the guide unit A by use of a pin.

When the rod of the fluid pressure cylinder 6 retracts, the arm 8; i.e., the guide plates 1, move counterclockwise. When the rod projects, the arm 8; i.e., the guide plates 1, move clockwise. That is, the fluid pressure cylinder 6 causes the guide plates 1 to vertically swing through the corresponding holes 11.

3. Printing-Speed Detection Unit C

As shown in FIG. 1, the printing-speed detection unit C is, for example, a pulse generator or a tachogenerator connected to an unillustrated drive system of a press unit U of the rotary press and adapted to input to the control unit D a signal in proportion to the number of revolutions per unit time of the drive system; i.e., a printing speed signal.

4. Control Unit D

A predetermined low printing speed of the rotary press (for example, a speed slightly higher than the crawling speed, which is the lowest printing speed) is input beforehand to the control unit D as a preset printing speed. The control unit D receives a printing speed signal from the printing-speed detection unit C in order to detect a printing speed, and compares the detected printing speed and the preset printing speed. Depending on whether the detected printing speed is greater than the preset printing speed or not, the control unit D supplies a different operation signal to an unillustrated solenoid-operated directional control valve located in a fluid control circuit of the fluid pressure cylinder 6 of the position-changeover drive unit B. As a result, the solenoid-operated directional control valve performs changeover operations, so that the rod of the fluid pressure cylinder 6 projects and retracts.

The operation of the guide apparatus T during the folder S being engaged in folding will next be described with reference to FIGS. 1 and 3 to 6.

First, in FIG. 1, the rotary press including the press unit U and the folder S is operated at low speed so as to lead the web P to the folder S via the press unit U.

Specifically, the nipping rollers 12 nip and pull the web P, which is led thereto via the press unit U, to thereby lead the web P into the gap between the collect cylinder F and the cutting cylinder E. The cutting cylinder E and the collect cylinder F rotate counterclockwise and clockwise, respectively, in a synchronous condition. When the knife 15 of the rotating cutting cylinder E and the cutting bar 17 of the rotating collect cylinder F meet, the web P is cut. The pin 16 projecting from the outer circumferential surface of the collect cylinder F is stuck into the web P at a position located immediately behind the cut line.

As mentioned above, the pin 16 is stuck into the web P at a position located immediately behind the cut line; i.e., the pin 16 is stuck into a lead portion Q1. The lead portion Q1 is led into the gap between the paper guide 14 and the outer circumferential surface of the collect cylinder F while a portion of the web P subsequent to the lead portion Q1 is looped around and held on the outer circumferential surface of the collect cylinder F. Being pulled by the moving pin 16, the web P moves through the gap between the paper guide 14 and the outer circumferential surface of the collect cylinder F.

Then, when the knife 15 of the cutting cylinder E and the cutting bar 17 meet, the subsequent portion of the web P is cut. As a result, the sheet Q of predetermined length (in the present embodiment, ⅕ the circumferential length of the collect cylinder F) is cut off from the web P. Being pulled by the moving pin 16, the sheet Q moves further through the gap between the paper guide 14 and the outer circumferential surface of the collect cylinder F. The lead portion Q1 of the sheet Q passes a narrowest-gap position 25 where the gap between the outer circumferential surface of the collect cylinder F rotating clockwise and the outer circumferential surface of the jaw cylinder G rotating counterclockwise becomes narrowest.

The web P is repeatedly cut to a predetermined length as mentioned above. The thus-yielded sheets Q move one after another.

In printing preparation work for leading the web P and carrying out various adjustments, operation at low printing speed is repeatedly started and stopped. Thus, during printing preparation work, as shown in FIG. 3, the solenoid-operated directional control valve located in the fluid control circuit of the fluid pressure cylinder 6 of the position-changeover drive unit B causes a changeover operation in response to a signal output from the control unit D, such that the rod of the fluid pressure cylinder 6 retracts.

Figure 6:
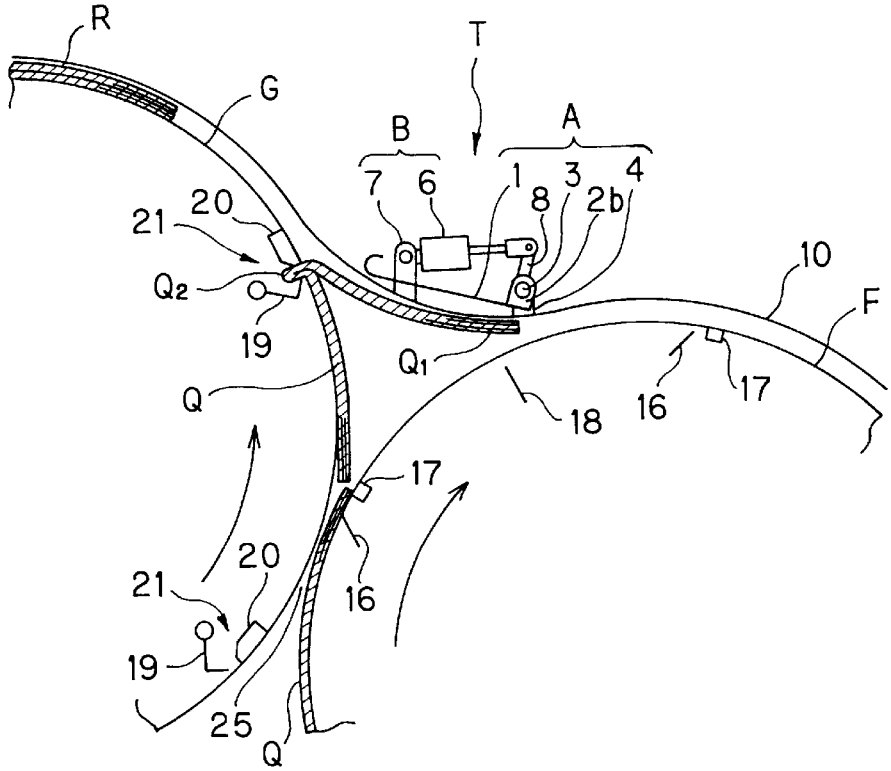
Figure 7:
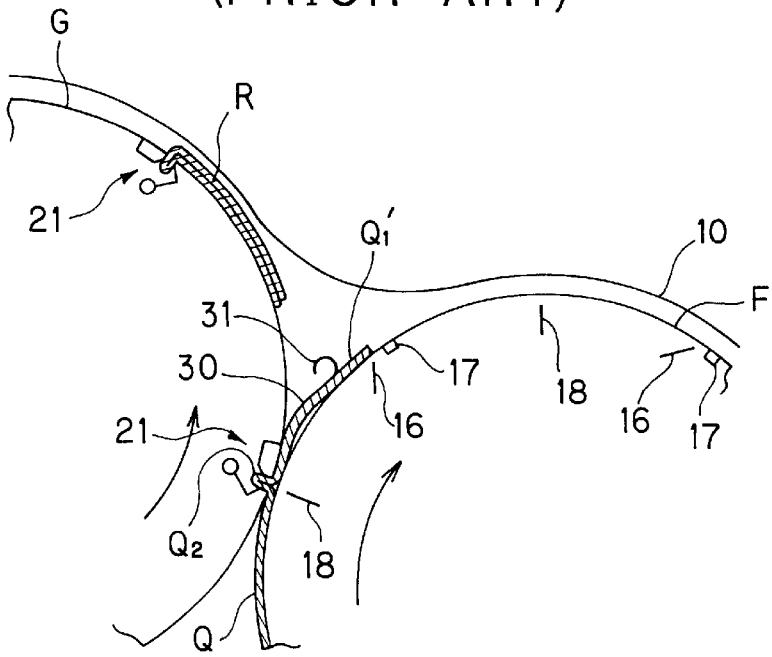
FIG. 7 (PRIOR ART)
FIGS. 7 to 9 are schematic partial side views illustrating the operation of a conventional guide apparatus.
Figure 8:
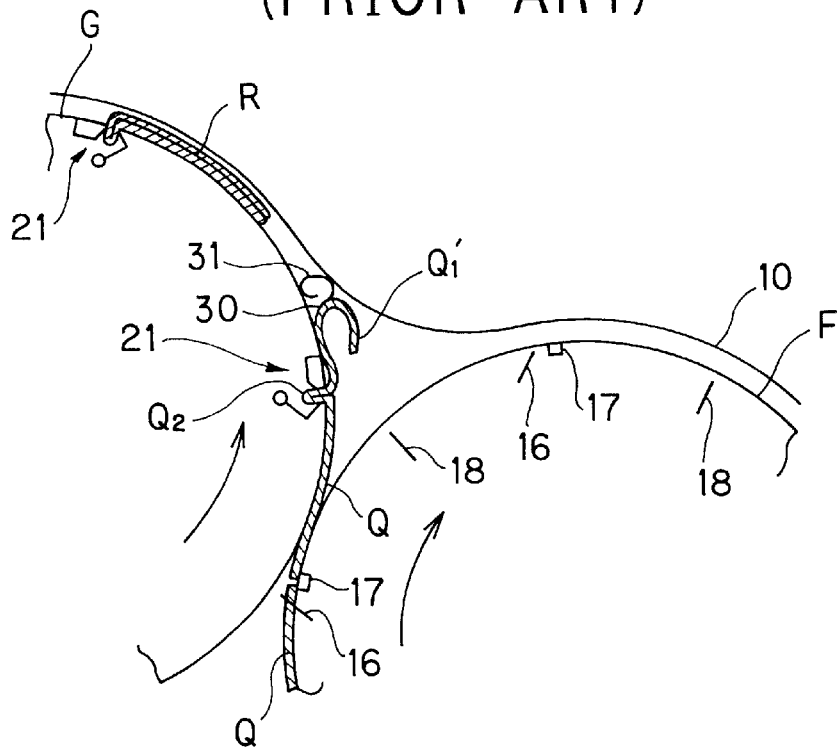
FIG. 8 (PRIOR ART)
Figure 9:
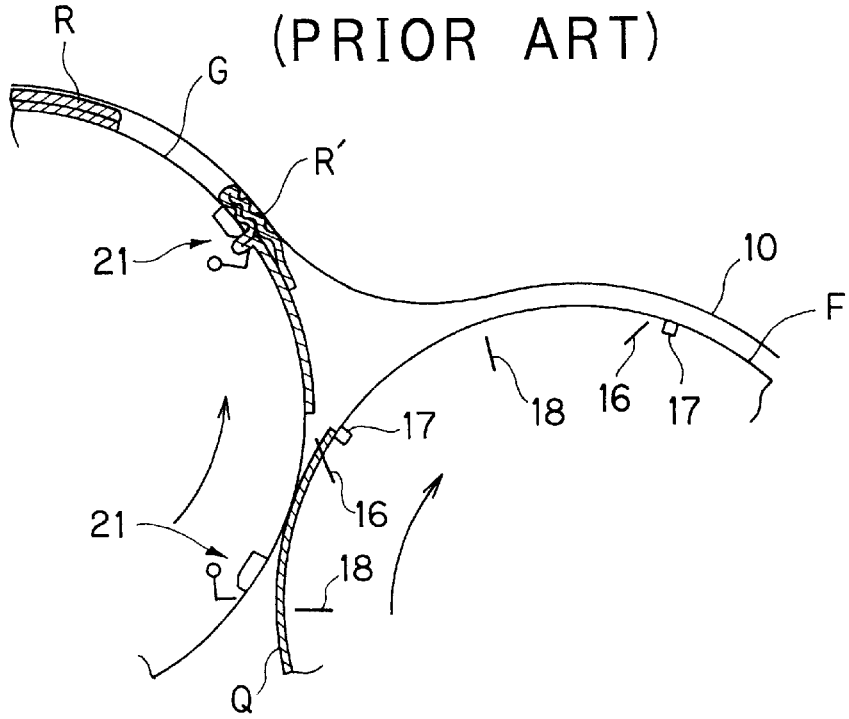
FIG. 9 (PRIOR ART)

Upon retraction of the rod of the fluid pressure cylinder 6, the guide plates 1 of the guide unit A rotates counterclockwise from the retreat position shown in FIG. 6; i.e., the position above the paper guide 10 at which the guide plates 1 do not interfere with the sheet Q transferring within the sheet transfer space from the collect cylinder F to the jaw cylinder G. As a result, the guide plates 1 pass through the corresponding holes 11 formed in the paper guide 10 and reach the active position located within the sheet transfer space 26 and apart from the outer circumferential surface of the collect cylinder F to such an extent as not to allow the lead portion Q1 of the sheet Q to slack (see FIG. 3).

Figure 3:
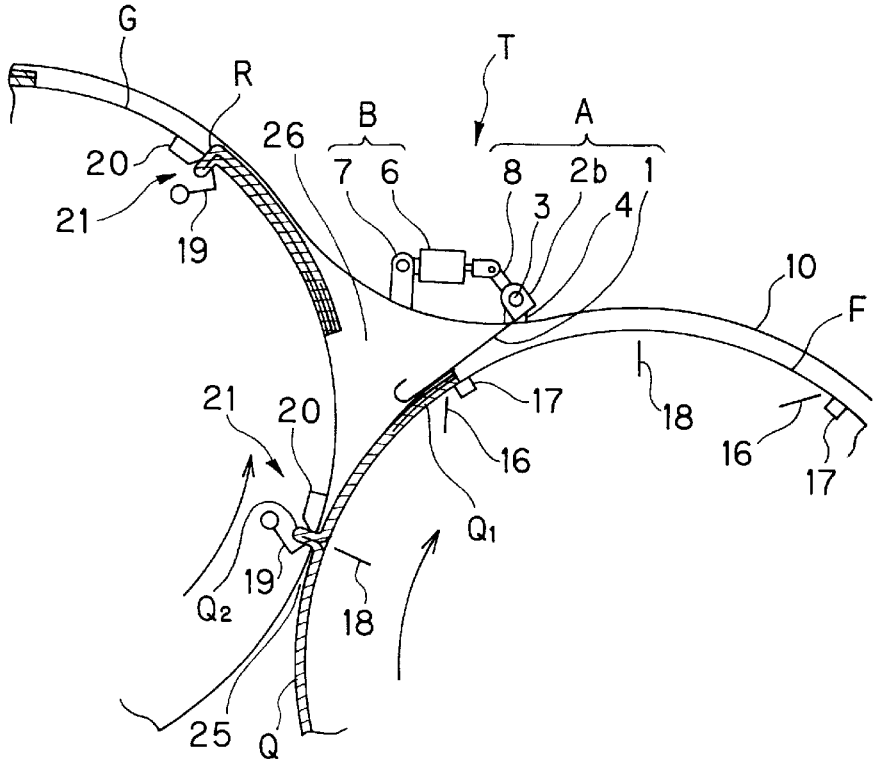
FIG. 3 is a schematic partial side view of the folder of FIG. 1, illustrating the operation of the guide apparatus according to the embodiment.

As the pin 16 of the collect cylinder F moves as a result of the collect cylinder F rotating, the lead portion Q1 of the sheet Q held by the pin 16 is smoothly inserted into the gap between the collect cylinder F and the guide plates 1 each having a curled end, and the sheet Q is led through the gap along the guide plates 1 (see FIG. 3).

Subsequently, when a lengthwise central portion Q2 of the sheet Q and the corresponding tucking blade 18, which are located at the same angular position, reach the narrowest-gap position 25 where the gap between the collect cylinder F and the jaw cylinder G is narrowest, the jaw mechanism 21 of the jaw cylinder G which has the same rotational phase (i.e., is located at the same angular position) as the tucking blade 18 faces the tucking blade 18. The tucking blade 18 of the collect cylinder F projects from the outer circumferential surface of the collect cylinder F. As a result, the central portion Q2 is projected toward the jaw cylinder G to thereby be gripped by the jaw mechanism 21 provided on the jaw cylinder G; i.e., the central portion Q2 is gripped between the movable jaw 19 and the stationary jaw 20. The tucking blade 18 which has projected immediately retracts (see FIG. 3).

Synchronously with or slightly before projection of the tucking blade 18, as shown in FIG. 3, the pin 16 of the collect cylinder F which has held the lead portion Q1 of the sheet Q retracts behind the outer circumferential surface of the collect cylinder 16 to thereby be withdrawn from the lead portion Q1. At this time, since the lead portion Q1 of the sheet Q is already guided by the guide plates 1, the lead portion Q1 does not become slack or curl even during printing preparation work, which involves frequent start and stop of low-printing-speed operation of the rotary press.

Figure 4:
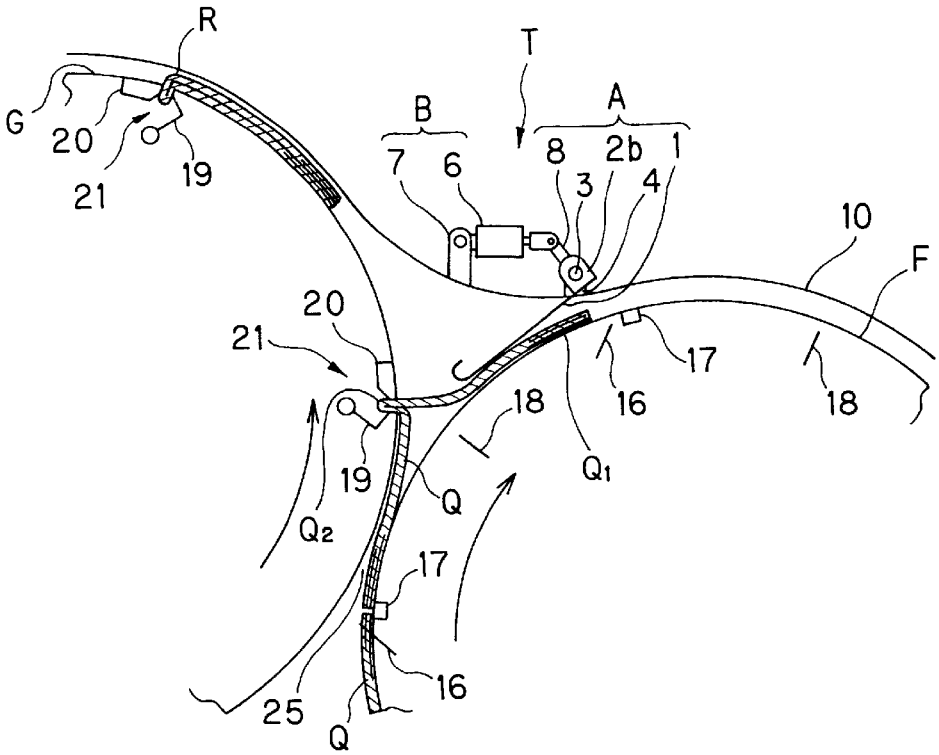
FIGS. 4 to 6 are schematic partial side views of the folder of FIG. 1, illustrating the operation of the guide apparatus according to the embodiment.

As shown in FIG. 4, after the pin 16 of the collect cylinder F is withdrawn from the lead portion Q1 of the sheet Q as shown in FIG. 3, the lead portion Q1 moves deeper into the gap between the guide plates 1 and the outer circumferential surface of the collect cylinder F for a while as the central portion Q2 of the sheet Q held on the jaw cylinder G moves as a result of the jaw cylinder G rotating.

Figure 5:
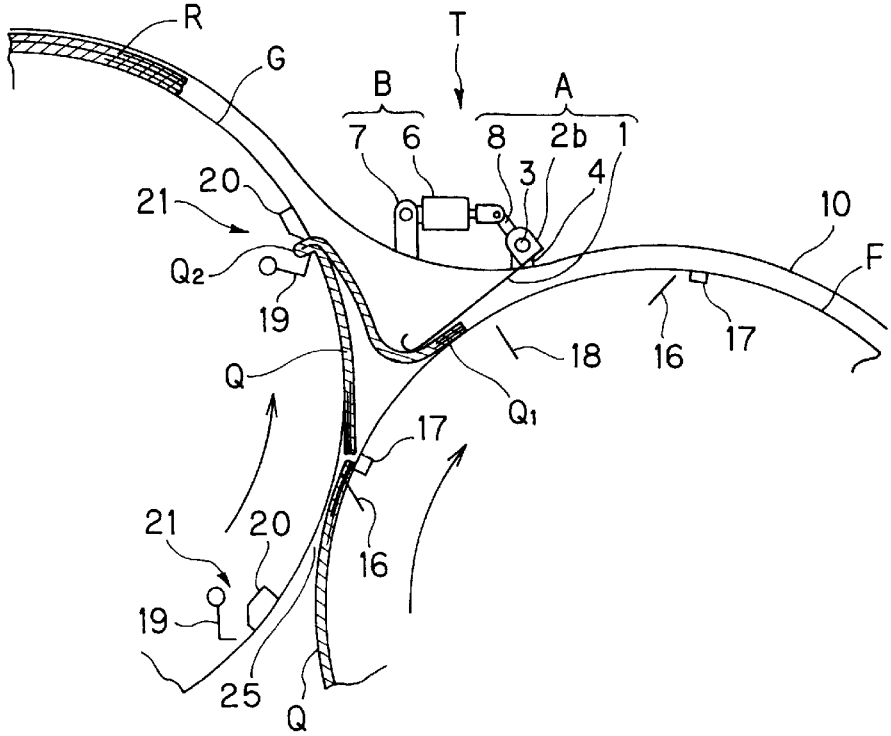

Then, as shown in FIG. 5, the central portion Q2 of the sheet Q held on the jaw cylinder G is inserted into the gap between the paper guide 10 and the outer circumferential surface of the jaw cylinder G as a result of the jaw cylinder G rotating. As the central portion Q2 moves further through the gap, the lead portion Q1 of the sheet Q begins to be pulled in the direction opposite the rotational direction of the collect cylinder F; i.e., the moving direction of the lead portion Q1 reverses to thereby be withdrawn from the gap between the guide plates 1 and the outer circumferential surface of the collect cylinder F.

When the lead portion Q1 of the sheet Q is withdrawn from the gap, the surface of the lead portion Q1 rubs against end portions of the guide plates 1. However, because of operation at low printing speed, the moving direction of the lead portion Q1 reverses gently. Thus, the lead portion Q1 does not rub strongly against end portions of the guide plates 1; therefore, the surface of the lead portion Q1 is free from scratches or stains.

As the central portion Q2 of the sheet Q moves further through the gap between the paper guide 10 and the outer circumferential surface of the jaw cylinder G, the lead portion Q1 of the sheet Q moves from the outer circumferential surface of the collect cylinder F toward the jaw cylinder G within the sheet transfer space 26, which has a substantially triangular cross section and is defined by the outer circumferential surfaces of the collect cylinder F and the jaw cylinder G and a portion of the paper guide 10 extending between the collect cylinder F and the jaw cylinder G. The former half of the sheet Q including the lead portion Q1 and the latter half of the sheet Q subsequent to the central portion Q2 are drawn into the gap between the paper guide 10 and the outer circumferential surface of the jaw cylinder G while being superposed on each other.

The sheet Q is folded along the central portion Q2 held by the jaw mechanism 21 to become the folded sheet R. After moving through the gap between the paper guide 10 and the outer circumferential surface of the jaw cylinder G, the folded sheet R moves further while being held between the outer circumferential surface of the jaw cylinder G and the endless belt 13*d* of the signature guide belt 13 subsequent to the downstream end of the paper guide 10. When the folded sheet R reaches the position where the endless belt 13*d* and the outer circumferential surface of the jaw cylinder G move away from each other, the jaw mechanism 21 releases the folded sheet R; i.e., the movable jaw 19 moves away from the stationary jaw 20. The released folded sheet R drops into an unillustrated fan and is then ejected to the exterior of the rotary press (see FIG. 1).

After printing preparation work at low printing speed is completed, the printing speed is gradually increased toward start of regular printing. When the printing speed of the press unit U of the rotary press exceeds the preset speed stored in the control unit D, the control unit D outputs a signal to the solenoid-operated directional control valve located in the fluid control circuit of the fluid pressure cylinder 6 of the position-changeover drive unit B. Through changeover of the solenoid-operated directional control valve, the rod of the fluid pressure cylinder 6 projects.

As a result, the guide plates 1 of the guide unit A situated at the active position begins to swing clockwise. The guide plates 1 pass through the corresponding holes 11 formed in the paper guide 10 to move away from the sheet transfer space 26 until they reach the retreat position located outside the paper guide 10.

When the printing speed of the rotary press reaches a level of high-speed printing, slack or curl of the lead portion Q1 is no longer involved. Specifically, the web P is repeatedly cut to a predetermined length to thereby yield sheets Q. As mentioned previously, the thus-yielded sheets Q move one after another together with the collect cylinder F. Since an inertial force in the rotational direction of the collect cylinder F is exerted on the lead portion Q1 of the moving sheet Q more strongly than at low printing speed, the lead portion Q1 is not slacked or curled, even though the guides plate 1 of the guide unit A are retreated away from the sheet transfer space 26, and the pin 16 of the collect cylinder F is withdrawn from the lead portion Q1.

As the central portion Q2 of the sheet Q moves through the gap between the paper guide 10 and the outer circumferential surface of the jaw cylinder G, the lead portion Q1 of the sheet Q smoothly separates from the outer circumferential surface of the collect cylinder F and then moves within the sheet transfer space 26 toward the jaw cylinder G along the paper guide 10.

As in the case of low printing speed, as the central portion Q2 of the sheet Q moves further through the gap between the paper guide 10 and the outer circumferential surface of the jaw cylinder G, the former half of the sheet Q including the lead portion Q1 and the latter half of the sheet Q subsequent to the central portion Q2 are drawn into the gap between the paper guide 10 and the outer circumferential surface of the jaw cylinder G while being superposed on each other. The sheet Q is thus folded to become the folded sheet R, which is then ejected to the exterior of the rotary press (see FIG. 1).

While the present invention has been described with reference to the above embodiment, the present invention is not limited thereto, but may be modified as appropriate without departing from the spirit or scope of the invention. For example, the guide plate 1 of the guide unit A may assume the form of a rod. The fluid pressure cylinder 6 of the position-changeover drive unit B may be replaced with another drive unit, such as a motor.

What is claimed is:

1. A guide apparatus for use in a folder in which a cutting cylinder and a jaw cylinder are disposed around a collect cylinder such that a gap is formed between the cutting cylinder and the collect cylinder and between the jaw cylinder face and the collect cylinder; pairs each consisting of a cutting bar extending axially and a pin are circumferentially arranged on an outer circumferential surface of the collect cylinder at circumferential intervals each corresponding to a length of a sheet such that the pins are projectable from an outer circumferential surface of the collect cylinder at locations adjacent to and behind the corresponding cutting bars in the rotational direction of the collect cylinder; tucking blades extending axially are each disposed at a substantially circumferentially central position between adjacent two of the cutting bars to be projectable from the outer circumferential surface of the collect cylinder; a knife extending axially projects from the outer circumferential surface of the cutting cylinder; jaw mechanisms are circumferentially arranged on the outer circumferential surface of the jaw cylinder at circumferential intervals each corresponding to the length of a sheet; a paper guide is disposed over an appropriate range covering a portion of the outer circumferential surface of the collect cylinder and a portion of the outer circumferential surface of the jaw cylinder, which portions are located downstream of a narrowest gap between the collect cylinder and the jaw cylinder with respect to rotational directions of the collect cylinder and the jaw cylinder, such that an inner surface of the paper guide faces the outer circumferential surfaces of the collect cylinder and the jaw cylinder while an appropriate gap is maintained therebetween and such that the inner surface of the paper guide, together with the outer circumferential surfaces of the collect cylinder and the jaw cylinder, defines a sheet transfer space having a substantially triangular cross section; and the knife and the cutting bar cooperatively cut off a sheet of predetermined length from a web, while the jaw mechanism and the tucking blade cooperatively fold the sheet; the guide apparatus comprising:

a guide unit disposed in such a manner as to be able to move between an active position located within the sheet transfer space and apart from the outer circumferential surface of the collect cylinder to such an extent as not to allow the sheet to slack, and a retreat position where the guide unit does not interfere with the sheet transferring from the collect cylinder to the jaw cylinder;

a position-changeover drive unit for moving the guide unit between the active position and the retreat position;

a printing-speed detection unit for detecting driving speed of a rotary press and outputting a driving speed signal during printing; and a control unit for outputting, upon reception of the driving speed signal from the printing-speed detection unit, a position changeover signal to the position-changeover drive unit in order to move the guide unit accordingly.

2. A guide apparatus for use in a folder according to claim 1, wherein the guide unit comprises two elongated guide plates which extend in the transferring direction of the sheet within the sheet transfer space and which are supported on the paper guide to be movable between the active position and the retreat position.

3. A guide apparatus for use in a folder according to claim 2, wherein the position-changeover drive unit comprises a hydraulic cylinder operatively connected to the elongated guide plates and adapted to move the guide plates between the active position and the retreat position.

* * * * *